US009889999B2

(12) United States Patent
Ueno

(10) Patent No.: US 9,889,999 B2
(45) Date of Patent: Feb. 13, 2018

(54) SHEET SUPPLYING DEVICE, SHEET STORING DEVICE, SHEET USING APPARATUS, AND LIQUID DISCHARGING APPARATUS

(71) Applicant: Satoshi Ueno, Tokyo (JP)

(72) Inventor: Satoshi Ueno, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/296,399

(22) Filed: Oct. 18, 2016

(65) Prior Publication Data

US 2017/0136784 A1 May 18, 2017

(30) Foreign Application Priority Data

Nov. 16, 2015 (JP) ..... 2015-224202

(51) Int. Cl.
*B65H 3/02* (2006.01)
*B41J 11/00* (2006.01)

(52) U.S. Cl.
CPC ..... *B65H 3/02* (2013.01); *B41J 11/007* (2013.01)

(58) Field of Classification Search
CPC ..... B41J 11/007; B65H 3/02
See application file for complete search history.

(56) References Cited

FOREIGN PATENT DOCUMENTS

| | | | | |
|---|---|---|---|---|
| JP | 5-238575 | | 9/1993 | |
| JP | 2011-178514 | * | 9/2011 | ..... B65H 3/06 |

* cited by examiner

*Primary Examiner* — Henok Legesse
(74) *Attorney, Agent, or Firm* — Cooper & Dunham LLP

(57) ABSTRACT

A sheet supplying device is provided. The sheet supplying device includes a separator to separate sheets one by one. The separator includes a separation pad, a spring, and a separation pressure adjuster. The separation pad contacts each of the sheets. The spring applies a separation pressure to the separation pad. The separation pressure adjuster adjusts the separation pressure to one of separation pressure values variable in multiple steps.

11 Claims, 11 Drawing Sheets

SHEET SUPPLYING DEVICE, SHEET STORING DEVICE, SHEET USING APPARATUS, AND LIQUID DISCHARGING APPARATUS

CROSS-REFERENCE TO RELATED APPLICATIONS

This patent application is based on and claims priority pursuant to 35 U.S.C. § 119(a) to Japanese Patent Application No. 2015-224202, filed on Nov. 16, 2015, in the Japan Patent Office, the entire disclosure of which is hereby incorporated by reference herein.

BACKGROUND

Technical Field

The present disclosure relates to a sheet supplying device, a sheet storing device, a sheet using apparatus, and a liquid discharging apparatus.

Description of the Related Art

A sheet supplying device is known which separates and supplies stacked sheets one by one. In particular, a friction-type sheet supplying device is known which uses a separation pad (friction pad) for separating sheets. However, this type of sheet supplying device has low robustness with respect to variation in sheet thickness and is likely to cause multiple feeding or non-feeding.

SUMMARY

In accordance with some embodiments of the present invention, a sheet supplying device is provided. The sheet supplying device includes a separator to separate sheets one by one. The separator includes a separation pad, a spring, and a separation pressure adjuster. The separation pad contacts each of the sheets. The spring applies a separation pressure to the separation pad. The separation pressure adjuster adjusts the separation pressure to one of separation pressure values variable in multiple steps.

In accordance with some embodiments of the present invention, a sheet storing device is provided. The sheet storing device includes a container to contain sheets and a separator to separate the sheets contained in the container one by one. The separator includes a separation pad, a spring, and a separation pressure adjuster. The separation pad contacts each of the sheets. The spring applies a separation pressure to the separation pad. The separation pressure adjuster adjusts the separation pressure to one of separation pressure values variable in multiple steps.

In accordance with some embodiments of the present invention, a sheet using apparatus is provided. The sheet using apparatus includes the above sheet storing device and a liquid discharger to discharge a liquid on the sheet to form an image.

In accordance with some embodiments of the present invention, a liquid discharging apparatus is provided. The liquid discharging apparatus includes the above sheet storing device and a liquid discharger to discharge a liquid on the sheet to form an image.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
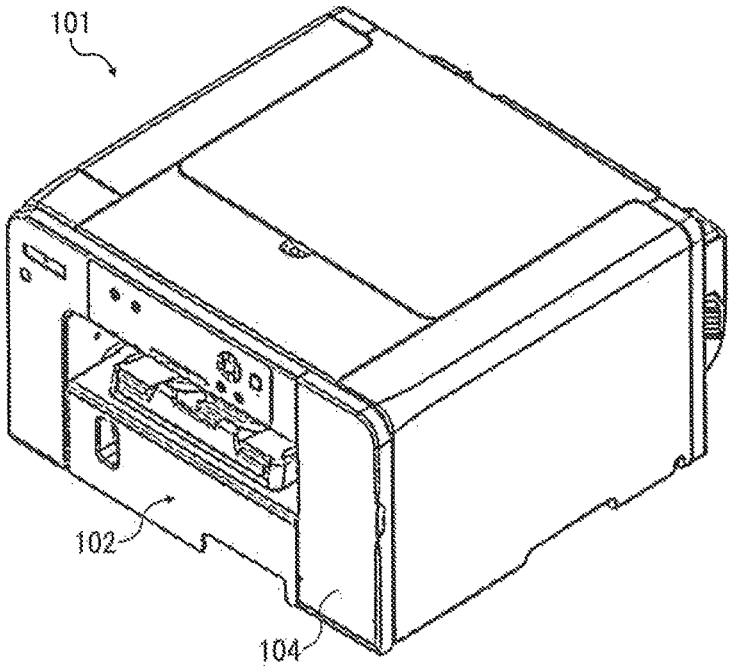
FIG. 1 is a perspective outline view of a sheet using apparatus according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

In accordance with some embodiments of the present invention, a sheet supplying device is provided which easily properly adjusts the separation pressure.

Figure 2:
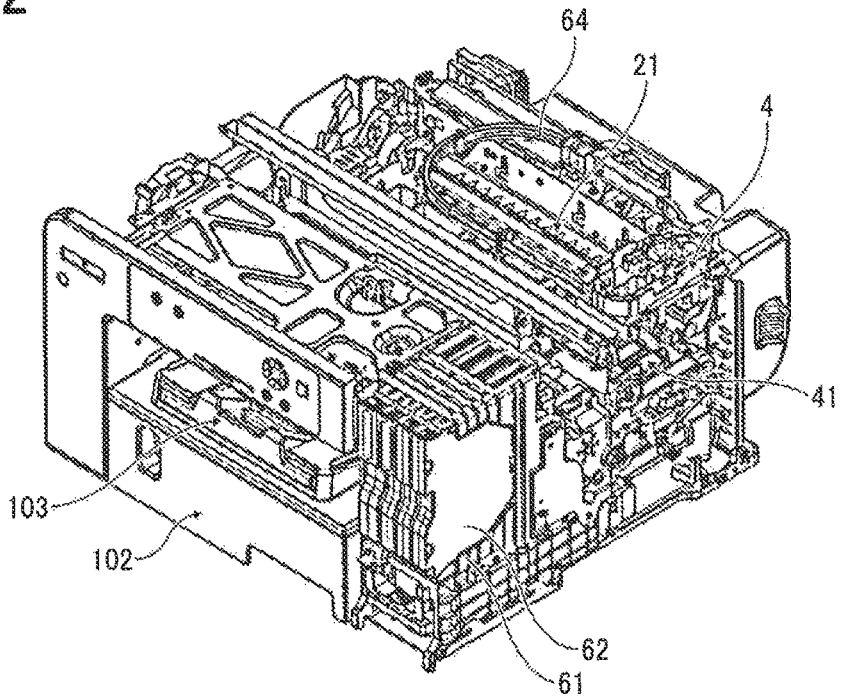
FIG. 2 is a perspective view of a mechanical section of the sheet using apparatus illustrated in FIG. 1.
Figure 3:
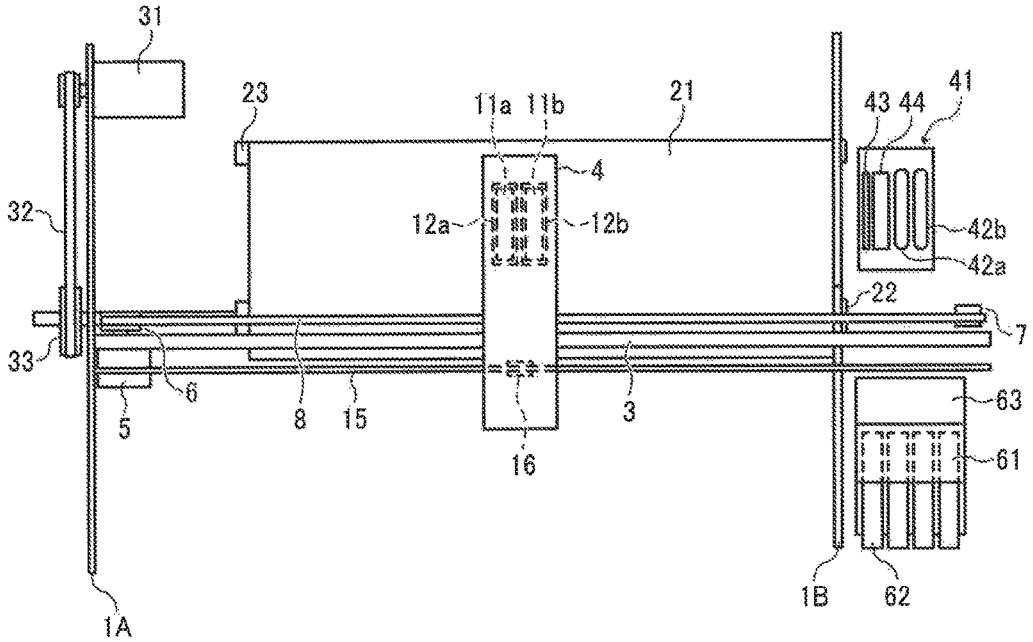
FIG. 3 is a plan view of a major part of the mechanical section illustrated in FIG. 2.
Figure 4:
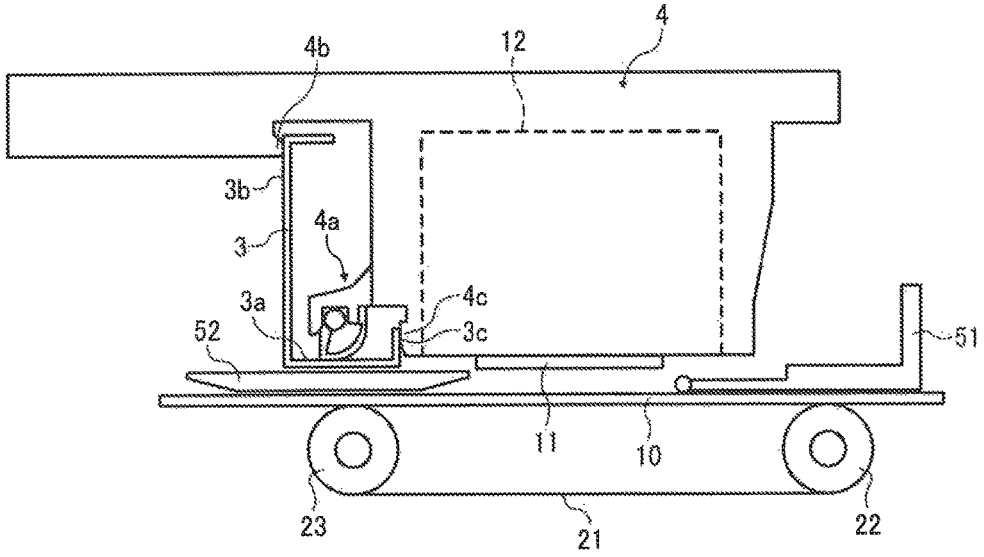
FIG. 4 is a side view of a carriage included in the sheet using apparatus illustrated in FIG. 1.

A sheet using apparatus according to an embodiment of the present invention is described below with reference to FIGS. 1 to 4. FIG. 1 is a perspective outline view of a sheet using apparatus according to an embodiment of the present invention. FIG. 2 is a perspective view of a mechanical section of the sheet using apparatus illustrated in FIG. 1. FIG. 3 is a plan view of a major part of the mechanical section illustrated in FIG. 2. FIG. 4 is a side view of a carriage included in the sheet using apparatus illustrated in FIG. 1.

The sheet using apparatus illustrated in FIG. 1 is configured to discharge a liquid onto a sheet to form an image thereon. The sheet using apparatus includes an apparatus body 101, a supply cassette 102 serving as a sheet storing device, and an ejection tray 103 for stacking ejected sheets thereon. The supply cassette 102 is detachably attached to a front surface side of the apparatus body 101. The ejection tray 103 is disposed above the supply cassette 102.

On a right side of the front surface of the apparatus body 101, a cover 104 is disposed. The cover 104 is openable and closable. When the cover 104 is opened, a liquid cartridge 62 can be attached to or detached from a cartridge holder 61 disposed in the apparatus body 101.

In the mechanical section, as illustrated in FIGS. 2 and 3, a guide member 3, formed of a platy member, is stretched between a pair of side plates 1A and 1B, and a carriage 4 is supported by the guide member 3 so as to be movable in the main scanning direction. A main scanning motor 5 moves the carriage 4 in the main scanning direction via a timing belt 8 that is wound around a driving pulley 6 and a driven pulley 7.

The guide member 3 is a platy member that guides movement of the carriage 4. The guide member 3 has a guide surface 3*a* serving as a support surface for guiding the carriage 4, and other guide surfaces 3*b* and 3*c*.

The carriage 4 has a rodless guide mechanism including a height adjuster 4*a*, a contact part 4*b*, and another contact part 4*c*. The height adjuster 4*a* is movably supported by the guide surface 3*a* of the guide member 3. The contact part 4*b* movably contacts the guide surface 3*b* of the guide member 3. The contact part 4*c* movably contacts the guide surface 3*c* of the guide member 3.

The carriage 4 includes heads 11*a* and 11*b* (hereinafter may be collectively "heads 11") for discharging liquids. Each of the heads 11*a* and 11*b* has two nozzle arrays. The four nozzle arrays, in total, are assigned to discharge liquids of yellow, cyan, magenta, and black, respectively.

The heads 11*a* and 11*b* integrally support respective head tanks 12*a* and 12*b* (hereinafter may be collectively "head tanks 12") for supplying liquids.

In the apparatus body 100, the liquid cartridge 62 is detachably mountable on the cartridge holder 61. A pump unit 63 supplies a liquid contained in the liquid cartridge 62 to the head tanks 12 via a supply tube 64 (illustrated in FIG. 2).

An encoder scale 15 is disposed along the main scanning direction of the carriage 4. An encoder sensor 16 for reading the scale of the encoder scale 15 is mounted on the carriage 4. The encoder sensor 16 is formed of a transmission photosensor. The encoder scale 15 and the encoder sensor 16 form a linear encoder serving as a position detector.

Below the carriage 4, a conveyance belt 21 for conveying a sheet 10 in the sub-scanning direction is disposed. The conveyance belt 21 is an endless belt stretched between a conveyance roller 22 and a tension roller 23. A sub-scanning motor 31 rotary-drives the conveyance roller 22 via a timing belt 32 and a timing pulley 33, to cause the conveyance belt 21 to circumferentially move in the sub-scanning direction.

As illustrated in FIG. 4, sheet guide members 51 and 52 are disposed in the vicinity of entrance and exit parts, respectively, of the conveyance belt 21.

On one lateral side of the conveyance belt 21 in the main scanning direction of the carriage 4, a maintenance unit 41 for maintaining the heads 11 is disposed.

The maintenance unit 41 includes a suction cap 42*a* and a moisture-retention cap 42*b* for capping the nozzle surfaces of the heads 11, a wiper 43 for wiping the nozzle surfaces, and a dummy discharge receptacle 44 for receiving dummy discharge liquid during maintenance. The suction cap 42*a* is connected to a suction pump serving as a suction device.

The sheet 10 fed from the supply cassette 102 is intermittently conveyed by the conveyance belt 21, while the carriage 4 is moved in the main scanning direction and the heads 11 are driven according to an image signal. This operation records one line of an image on the sheet 10 with the liquid discharged from the heads 11. After conveying the sheet 10 for a predetermined amount, this operation is repeated to record next line of the image on the sheet 10. Such a sheet-conveying and image-recording operation is repeated until formation of the image is completed. The sheet 10 having the image thereon is ejected from the apparatus body 100.

Figure 5:
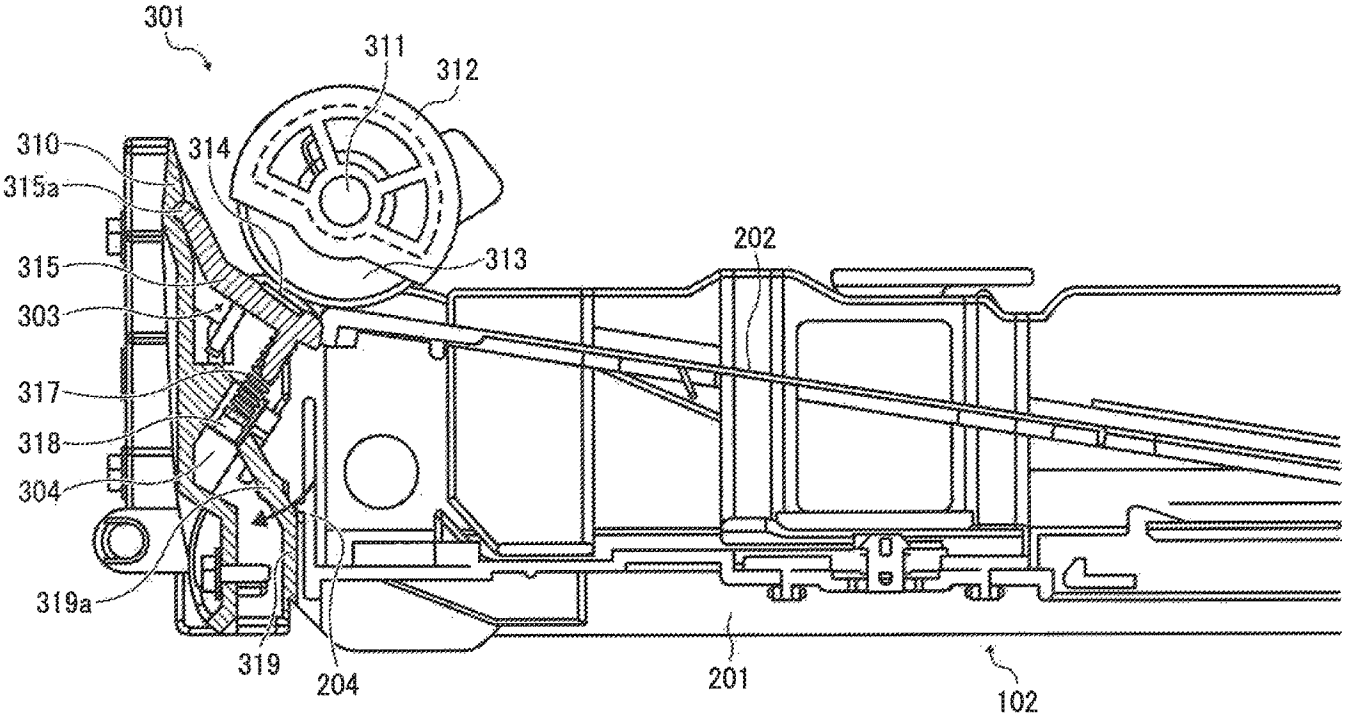
FIGS. 5 and 6 are cross-sectional and perspective views, respectively, of a sheet supplying device according a first embodiment of the present invention, attached to a supply cassette.
Figure 6:
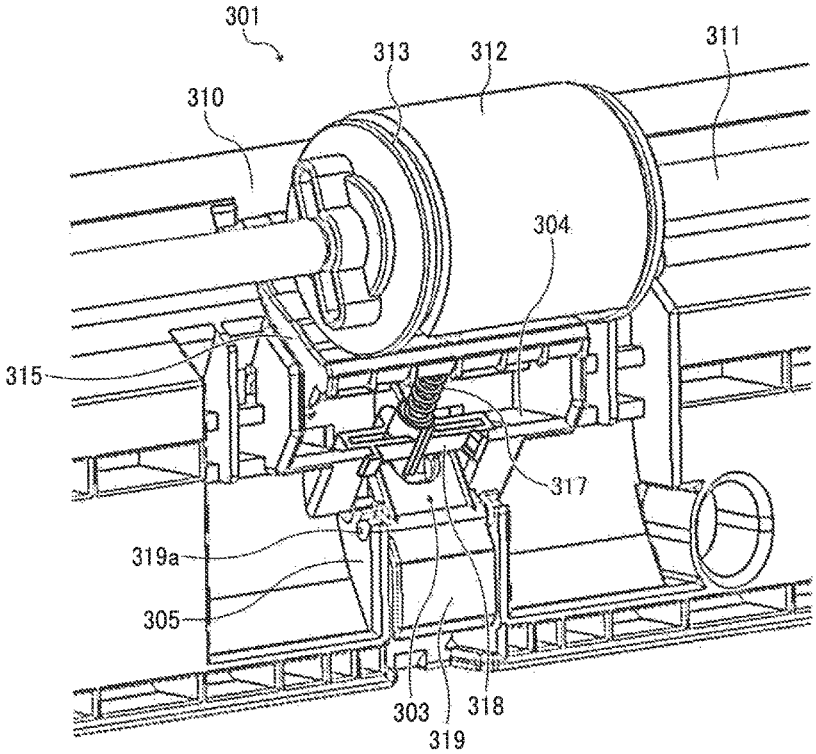
Figure 7:
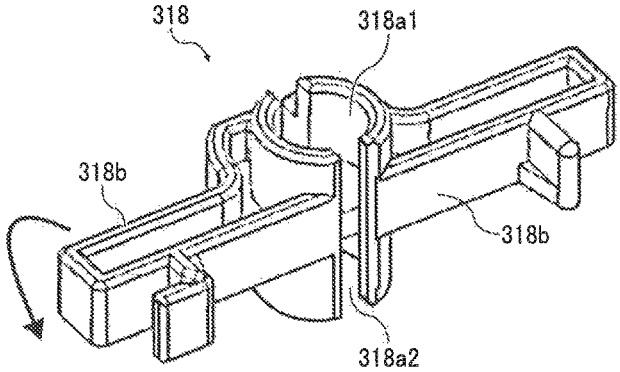
FIGS. 7 and 8 are perspective and elevation views of a spring holder included in the sheet supplying device illustrated in FIGS. 5 and 6.
Figure 8:
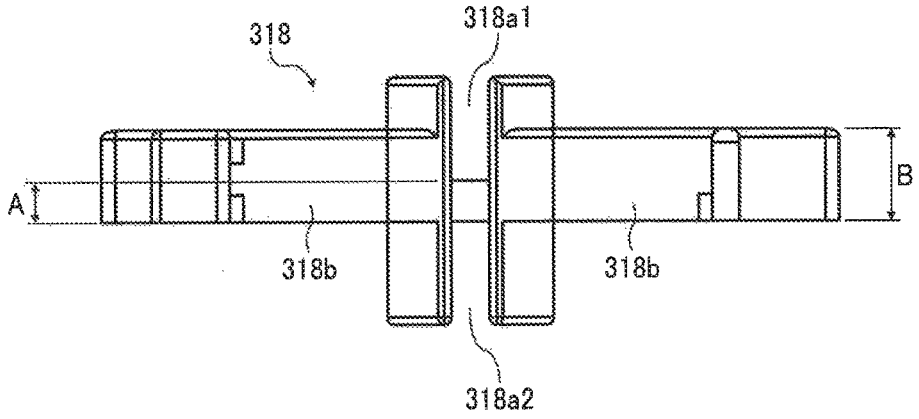

A sheet supplying device according to a first embodiment of the present invention, usable for the above-described sheet using apparatus, is described below with reference to FIGS. 5 to 8. FIGS. 5 and 6 are cross-sectional and perspective views, respectively, of a sheet supplying device 301 attached to the supply cassette 102. FIGS. 7 and 8 are perspective and elevation views of a spring holder 318 included in the sheet supplying device 300.

The supply cassette 102 includes a cassette body 201 for storing multiple sheets 10 and a bottom plate 202 for stacking the sheets 10 thereon.

The sheet supplying device 301 includes a supply roller 312 mounted on a shaft 311. On both axial ends of the supply roller 312, supply roller collars 313 are respectively disposed.

A separator 303 is disposed facing the supply roller 312. The separator 303 includes a friction pad 314 serving as a separation pad, and a friction pad holder 315 for holding the friction pad 314. The friction pad holder 315 has a shaft part 315*a* on a downstream side relative to the sheet supplying direction. The shaft part 315*a* is supported by a supply guide member 310 to make the friction pad holder 315 swingable.

On the opposite side of the friction pad 314 relative to the friction pad holder 315, a spring 317 is disposed. The spring 317 applies a separation pressure to the friction pad 314. The spring 317 is held by a spring holder 318. The spring holder 318 combines the function of adjusting the separation pressure, to be applied to the friction pad 314, to separation pressure values preset in multiple steps.

The spring holder 318 is movably held by a holder receiver 304. The spring holder 318 is in contact with one end part a friction pad pressing lever 319.

The friction pad pressing lever 319 has a shaft part 319*a*. The shaft part 319*a* is supported by a support 305 (illustrated in FIG. 6) to make the friction pad pressing lever 319 swingable. When the supply cassette 102 is mounted on the apparatus body 101, a front plate 204, disposed on a front side of the cassette body 201 in the mounting direction, presses the friction pad pressing lever 319. The friction pad pressing lever 319 thereby rotates in a direction indicated by arrow in FIG. 5 to push up the spring holder 318.

The friction pad pressing lever 319 is configured to release the separation pressure. When the supply cassette 102 is unmounted from the apparatus body 101, the one end of the friction pad pressing lever 319 in contact with the spring holder 318 is separated therefrom and the spring 317 restores to its original state. Thus, the separation pressure is released.

Referring to FIGS. 7 and 8, the spring holder 318 has spring receiving parts 318*a*1 and 318*a*2 and a mounting part 318*b* to be movably fitted into the holder receiver 304.

When mounted on the holder receiver 304, the spring holder 318 may be in either a regular posture as illustrated in FIGS. 7 and 8 or an upside-down posture.

When the spring holder 318 in the regular posture is mounted on the holder receiver 304, the distance between the friction pad pressing lever 319 and the seat of the spring 317 (i.e., the bottom surface of the spring receiving part 318*a*1) becomes A. When the spring holder 318 in the upside-down posture is mounted on the holder receiver 304, the distance between the friction pad pressing lever 319 and the seat of the spring 317 (i.e., the bottom surface of the spring receiving part 318*a*2) becomes B.

Owing to the above-described configuration, when the supply cassette 102 is mounted on the apparatus body 101, the cassette body 201 of the supply cassette 102 presses the friction pad pressing lever 319. The friction pad pressing lever 319 thereby rotates about the shaft part 319*a* in a direction indicated by arrow in FIG. 5, thus becoming a state illustrated in FIG. 5.

As the friction pad pressing lever 319 rotates, the spring holder 318 and the spring 317 are pushed up, and the friction pad holder 315 and the friction pad 314 are eventually pushed up toward the supply roller 312.

At this time, the separation pressure from the friction pad 314 is determined depending on the working length (i.e., compression amount) of the spring 317.

In the initial stage (factory default setting), the spring holder 318 in the regular posture is mounted on the holder receiver 304. At this time, as described above, the distance between the friction pad pressing lever 319 and the seat of the spring 317 becomes A.

When the spring holder 318 is turned upside down as indicated by arrow illustrated in FIG. 7 and mounted on the holder receiver 304 in the upside-down posture, the distance between the friction pad pressing lever 319 and the seat of the spring 317 is changed to B.

As a result, since the contact position of the friction pad 314 with the supply roller 312 is fixed, the working length (i.e., compression amount) of the spring 317 is changed. Thus, the separation pressure is changed in multiple steps (two steps in this case).

According to the present embodiment, the separation pressure from the friction pad is adjustable to separation pressure values preset in multiple steps. This configuration achieves much easier and more appropriate adjustment of the separation pressure compared to a case in which the separation pressure is adjustable continuously.

The method of changing the mounting posture of the spring holder is not limited to turning the spring holder upside down in the vertical direction. For example, the mounting posture can be varied by rotating the spring holder by 90 degrees.

Figure 9:
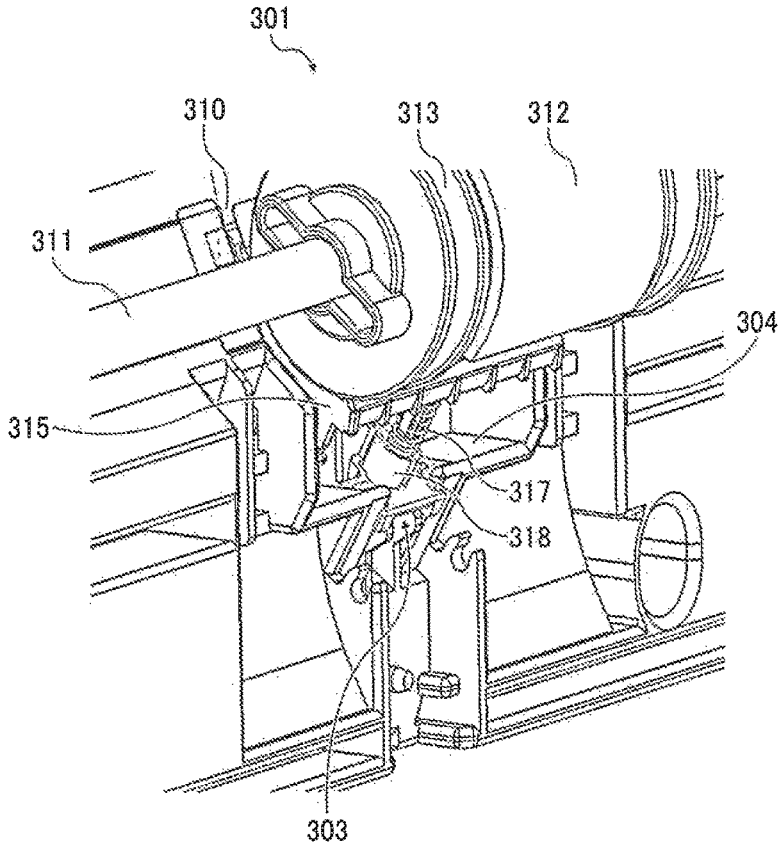
FIG. 9 is a perspective view of a major part of a sheet supplying device according to a second embodiment of the present invention.

A sheet supplying device according to a second embodiment of the present invention is descried below with reference to FIG. 9. FIG. 9 is a perspective view of a major part of the sheet supplying device according to the second embodiment of the present invention.

In the second embodiment, the friction pad pressing lever 319 used in the first embodiment is omitted. As the mounting posture of the spring holder 318 on the holder receiver 304 is changed, the working length (i.e., compression amount) of the spring 317 is changed. Thus, the separation pressure is adjustable in multiple steps.

In the present embodiment, the spring holder 318 needs not to be movable so long as the working length (i.e., compression amount) of the spring 317 is variable in accordance with a change in mounting posture on the holder receiver 304. Therefore, the spring holder 318 in the second embodiment, illustrated in FIG. 9, has a different shape from that in the first embodiment. Of course, the spring holder 318 in the second embodiment may have the same shape as that in the first embodiment.

Figure 10:
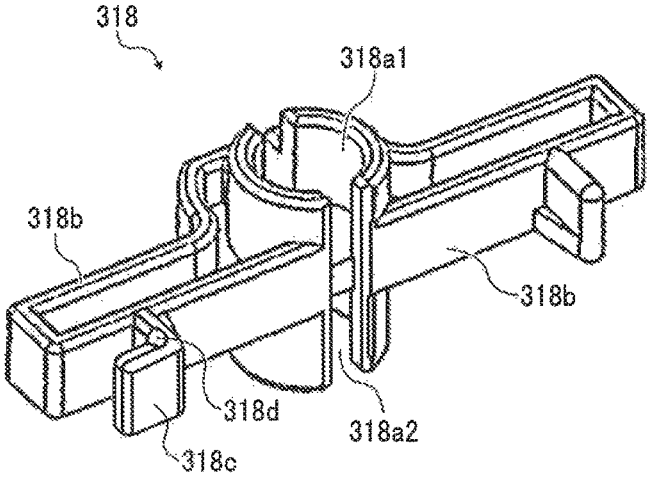
FIG. 10 is a perspective view of a spring holder included in a sheet supplying apparatus according to a third embodiment of the present invention.
Figure 11:
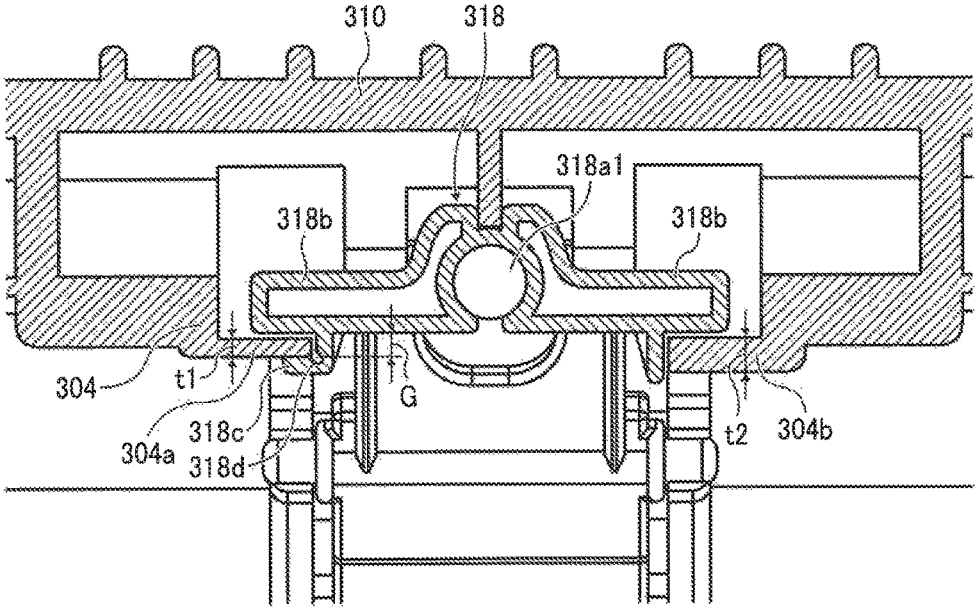
FIG. 11 is a plan view of the spring holder illustrated in FIG. 10 mounted on a holder receiver.

A sheet supplying device according to a third embodiment of the present invention is descried below with reference to FIGS. 10 and 11. FIG. 10 is a perspective view of the spring holder 318 included in the sheet supplying device according to the third embodiment. FIG. 11 is a plan view of the spring holder 318 illustrated in FIG. 10 mounted on the holder receiver 304.

The spring holder 318 has an improper assembly preventing part 318*c* serving as a posture regulator. A gap G is formed between the improper assembly preventing part 318*c* and the mounting part 318*b*. More specifically, the gap G is formed between an outer peripheral wall surface of the mounting part 318*b* and an inner wall surface (i.e., the surface facing the mounting part 318*b*) of the improper assembly preventing part 318*c*. The improper assembly preventing part 318*c* has a cutout 318*d*. The improper assembly preventing part 318*c* is easily removable by being broken.

On the other hand, the holder receiver 304 has guide parts 304*a* and 304*b* for guiding the mounting part 318*b* of the spring holder 318. The guide part 304*a* has a thickness t1 less then than the gap G formed by the improper assembly preventing part 318*c*. The guide part 304*b* has a thickness t2 greater than the gap G formed by the improper assembly preventing part 318*c*.

Thus, in the initial stage, the mounting part 318*b* of the spring holder 318 cannot be mounted on the holder receiver 304 unless the guide part 304*a* of the holder receiver 304 can be fitted into the gap G formed by the improper assembly preventing part 318*c*.

The initial mounting posture of the spring holder 318 is thus automatically determined and prevented from being mounted on the holder receiver 304 in the upside-down posture. When the improper assembly preventing part 318*c* is removed, the spring holder 318 in the upside-down posture can be mounted on the holder receiver 304.

Figure 12A:
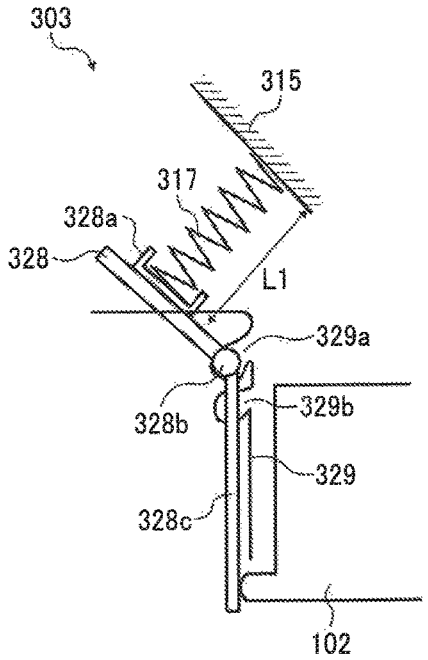
FIGS. 12A and 12B are side views of a major part of a sheet supplying device according to a fourth embodiment of the present invention.
Figure 12B:
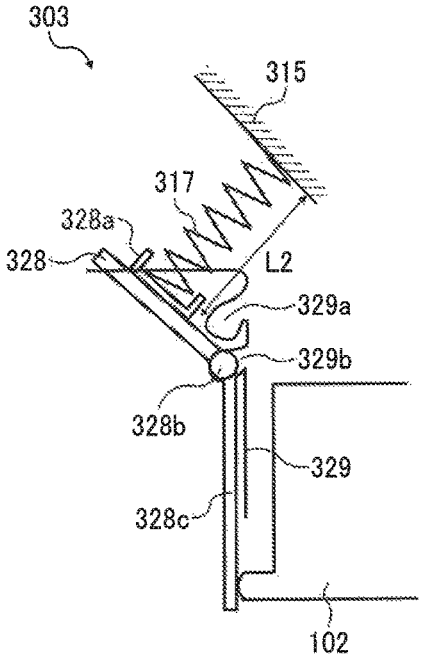

A sheet supplying device according to a fourth embodiment of the present invention is descried below with reference to FIGS. 12A and 12B. FIGS. 12A and 12B are side views of a major part of the sheet supplying device according to the fourth embodiment of the present invention.

In the present embodiment, a spring holder 328 includes a spring receiving part 328*a*, a shaft part 328*b*, and a lever part 328*c*. The shaft part 328*b* is rotatably held by a holder receiver 329. The lever part 328*c* is to be pressed by the cassette body 201 of the supply cassette 102.

The holder receiver 329 has holding parts 329*a* and 329*b* each disposed at different heights, for holding the shaft part 328*b* of the spring holder 328. The holder receiver 329 serves as a separation pressure adjuster.

The height of the spring holder 328 is varied depending on which one of the holding parts 329*a* and 329*b* is holding the shaft part 328*b* of the spring holder 328. As the height of the spring holder 328 is varied, the working length (i.e., compression amount) of the spring 317 is varied to vary (adjust) the separation pressure in multiple steps.

Figure 13:
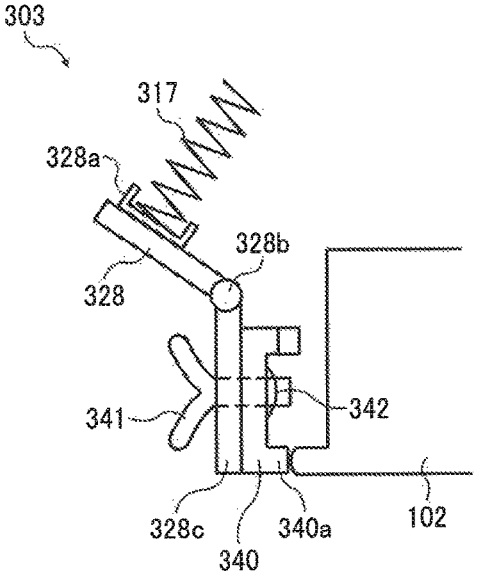
FIGS. 13 and 14 are side and elevation views, respectively, of a major part of a sheet supplying device according to a fifth embodiment of the present invention.
Figure 14:
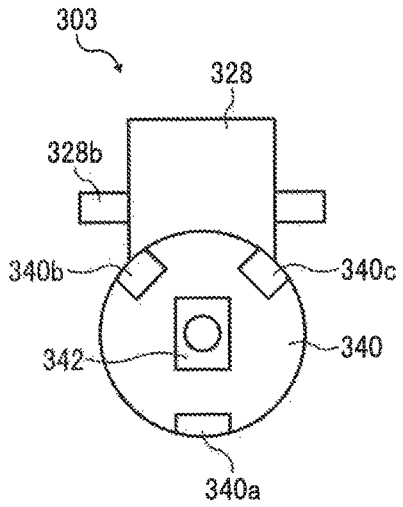

A sheet supplying device according to a fifth embodiment of the present invention is descried below with reference to FIGS. 13 and 14. FIGS. 13 and 14 are side and elevation views, respectively, of a major part of the sheet supplying device according to the fifth embodiment of the present invention.

In the present embodiment, a spring holder 328 includes a spring receiving part 328*a*, a shaft part 328*b*, and a lever part 328*c*. The shaft part 328*b* is rotatably held by a holder receiver. The lever part 328*c* is to be pressed by the cassette body 201 of the supply cassette 102.

The lever part 328*c* of the spring holder 328 is equipped with an adjuster 340. The adjuster 340 varies the contact distance between the lever part 328*c* and the supply cassette 102 to adjust the separation pressure.

The adjuster 340 has a circular disc shape. The adjuster 340 has multiple projections 340*a*, 340*b*, and 340*c* each different in height, to be brought into contact with the supply cassette 102. A rotary knob 341 is attached to the adjuster 340 with a plate spring 342.

As the adjuster 340 rotates, the contact distance between the lever part 328*c* and the supply cassette 102 is varied, the amount of tilt of the spring holder 328 is thereby varied, and the working length (i.e., compression amount) of the spring 317 is thereby varied to vary (adjust) the separation pressure in multiple steps.

Figure 15:
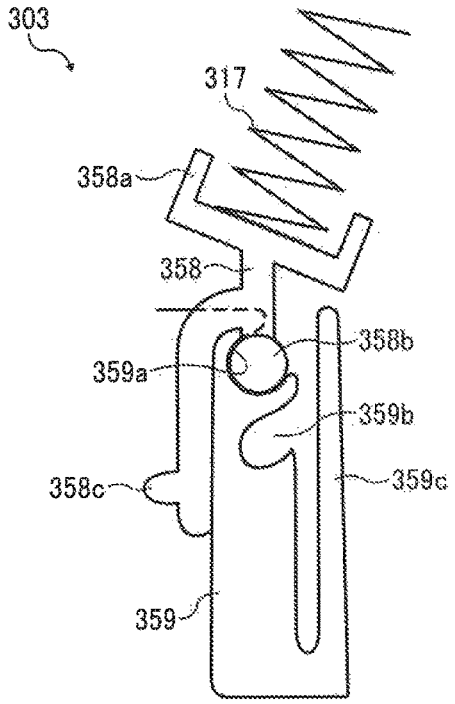
FIGS. 15 and 16 are side and elevation views, respectively, of a major part of a sheet supplying device according to a sixth embodiment of the present invention.
Figure 16:
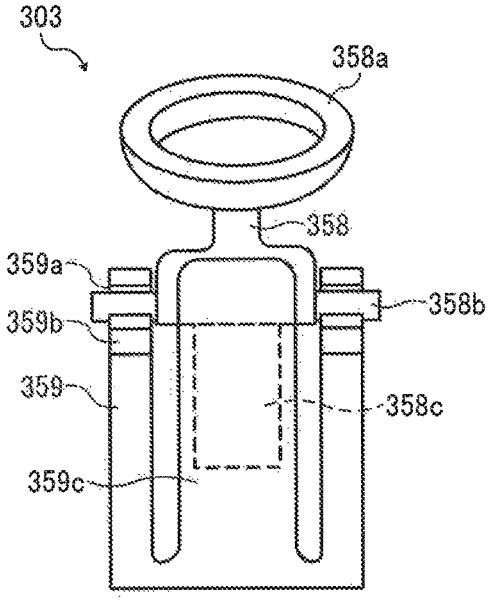

A sheet supplying device according to a sixth embodiment of the present invention is descried below with reference to FIGS. 15 and 16. FIGS. 15 and 16 are side and elevation views, respectively, of a major part of the sheet supplying device according to the sixth embodiment of the present invention.

Similar to the fourth embodiment, a spring holder 358 includes a spring receiving part 358*a*, a shaft part 358*b*, and a work knob 358*c*. The shaft part 358*b* is rotatably held by a holder receiver 359.

The holder receiver 359 has holding parts 359*a* and 359*b* each disposed at different heights, for holding the shaft part 358*b* of the spring holder 358. In addition, the holder receiver 359 has a fall preventing part 359*c* having elasticity, for preventing the shaft part 358*b* from falling off when held by the holding part 359*a* or 359*b*.

The height of the spring holder 358 is varied depending on which one of the holding parts 359*a* and 359*b* is holding the shaft part 358*b* of the spring holder 358. As the height of the spring holder 358 is varied, the working length (i.e., compression amount) of the spring 317 is varied to vary (adjust) the separation pressure in multiple steps.

Figure 17:
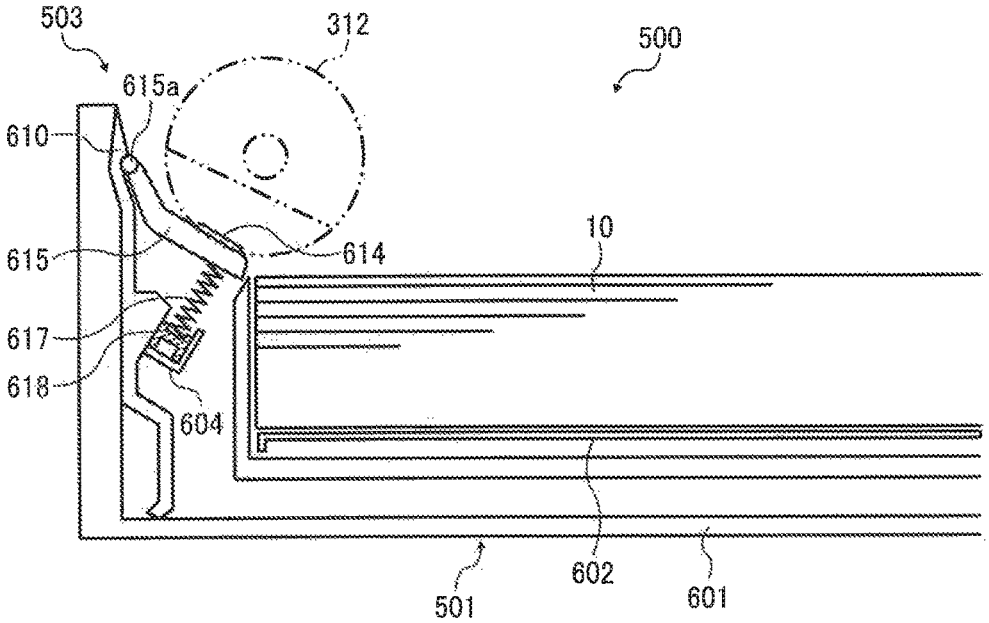
FIG. 17 is a side view of a major part of a sheet storing device according to a seventh embodiment of the present invention.

A sheet storing device according to a seventh embodiment of the present invention is descried below with reference to FIG. 17. FIG. 17 is a side view of a major part of the sheet storing device according to the seventh embodiment of the present invention.

A sheet storing device 500 includes a container 501 for containing sheets 10 and a separator 503 for separating and supplying the sheets 10 contained in the container 501 one by one.

The container 501 includes a container body 601 for storing multiple sheets 10, a bottom plate 602 for stacking the sheets 10 thereon, and a guide member 610 for guiding the sheets 10 to be fed.

Similar to the second embodiment, the separator 503 includes a friction pad 614 serving as a separation pad, and a friction pad holder 615 for holding the friction pad 614. The friction pad 614 faces the supply roller 312 when the sheet storing device 500 is mounted on the above-described sheet using device.

The friction pad holder 615 has a shaft part 615*a* on a downstream side relative to the sheet supplying direction. The shaft part 615*a* is supported by the guide member 610 of the container body 601 to make the friction pad holder 615 swingable.

On the opposite side of the friction pad 614 relative to the friction pad holder 615, a spring 617 is disposed. The spring 617 applies a separation pressure to the friction pad 614. The spring 617 is held by a spring holder 618. The spring holder 618 combines the function of adjusting the separation pressure, to be applied to the friction pad 614, to separation pressure values present in multiple steps.

The spring holder 618 is held by a holder receiving part 604 of the guide member 610. When held by the holder receiving part 604, the spring holder 618 may be in either a regular posture or an upside-down posture, similar to the first and third embodiments.

As the posture of the spring holder 618 held on the holder receiving part 604 is changed, the working length (i.e., compression amount) of the spring 617 is changed. Thus, the separation pressure is adjustable in multiple steps.

Similar to the third embodiment, the spring holder 618 and the holder receiving part 604 may include a posture regulator.

Figure 18:
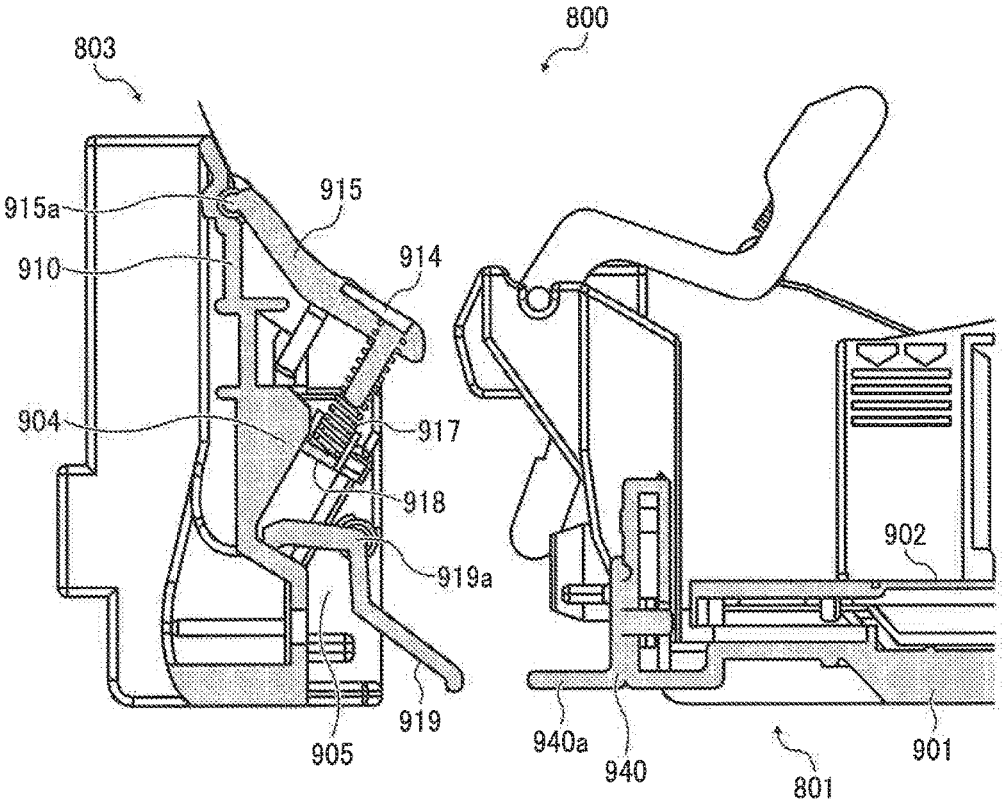
FIG. 18 is a side view of a major part of a sheet storing device according to an eighth embodiment of the present invention.
Figure 19:
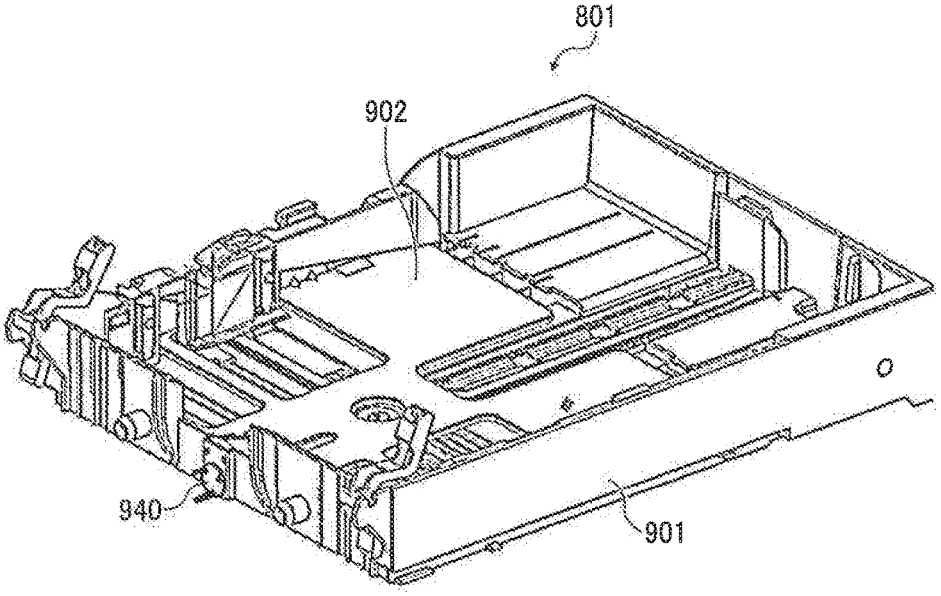
FIG. 19 is a perspective view of a container included in the sheet storing device illustrated in FIG. 18.
Figure 20:
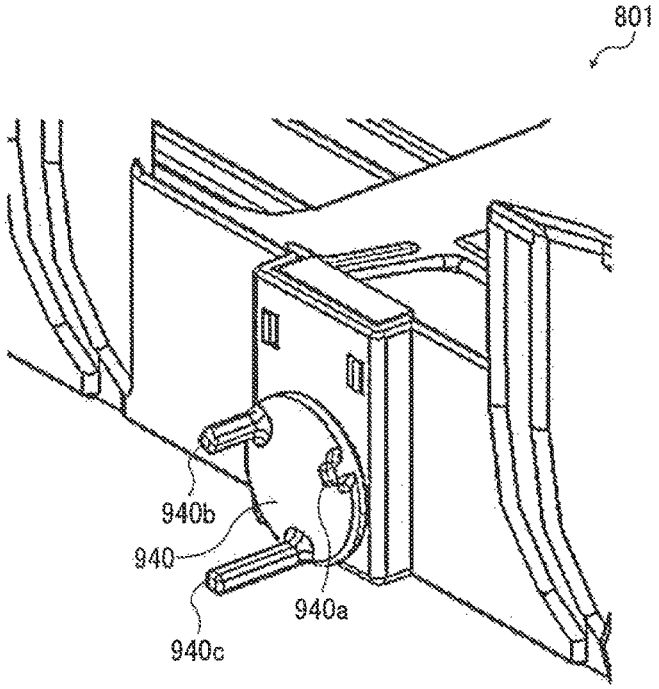
FIG. 20 is a magnified perspective view of a major part of the container illustrated in FIG. 19.

A sheet storing device according to an eighth embodiment of the present invention is descried below with reference to FIGS. 18 to 20. FIG. 18 is a side view of a major part of the sheet storing device according to the eighth embodiment. FIG. 19 is a perspective view of a container included in the sheet storing device illustrated in FIG. 18. FIG. 20 is a magnified perspective view of a major part of the container illustrated in FIG. 19.

A sheet storing device 800 includes a container 801 for containing sheets 10 and a separator 803 for separating and supplying the sheets 10 contained in the container 801 one by one.

Similar to the supply cassette 102 of the first embodiment, the container 801 includes a cassette body 901 for storing multiple sheets 10 and a bottom plate 902 for stacking the sheets 10 thereon.

Similar to the sheet supplying device 301 according to the first embodiment, the separator 803 includes a friction pad 914 serving as a separation pad, and a friction pad holder 915 for holding the friction pad 914. The friction pad 914 faces the supply roller 312 when the sheet storing device 800 is mounted on the above-described sheet using device.

The friction pad holder 915 has a shaft part 915*a* on a downstream side relative to the sheet supplying direction.

The shaft part 915*a* is supported by a guide member 910 to make the friction pad holder 915 swingable.

On the opposite side of the friction pad 914 relative to the friction pad holder 915, a spring 917 is disposed. The spring 917 applies a separation pressure to the friction pad 914.

The spring 917 is held by a spring holder 918. The spring holder 918 is movably held by a holder receiver 904.

The spring holder 918 is in contact with one end part a friction pad pressing lever 919. The friction pad pressing lever 919 has a shaft part 919*a*. The shaft part 919*a* is supported by a support 905 to make the friction pad pressing lever 919 swingable.

The cassette body 901 of the container 801 is equipped with an adjuster 940, similar to the adjuster 340 of the fifth embodiment, disposed on a front side of the cassette body 901 relative to the mounting direction thereof. The adjuster 940 varies the amount of rotation of the friction pad pressing lever 919.

The adjuster 940 has a circular disc shape. The adjuster 940 has multiple projections 940*a*, 940*b*, and 940*c* each different in height, to be brought into contact with the friction pad pressing lever 919.

As the adjuster 940 rotates, one of the projections 940*a*, 940*b*, and 940*c* to be brought into contact with the friction pad pressing lever 919 is changed, and the amount of rotation of the friction pad pressing lever 919 when the container 801 mounted is thereby varied.

As the amount of rotation of the friction pad pressing lever 919 is varied, the amount of movement of the spring holder 918 is varied, and the working length (i.e., compression amount) of the spring 917 is thereby varied to vary (adjust) the separation pressure in multiple steps.

In the above-described embodiments, the sheet using apparatus serves as a liquid discharging apparatus, the sheet supplying device supplies sheets to the liquid discharging apparatus, and the sheet storing device stores sheets to be supplied to the liquid discharging apparatus. The sheet using apparatus may be configured to form (record, print) not only an image (including tests and graphics) but also a circuit pattern on a sheet material.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A sheet supplying device comprising:

a separator to separate sheets one by one, including:

a separation pad to contact each of the sheets;

a spring to apply a separation pressure to the separation pad; and a separation pressure adjuster to adjust the separation pressure to one of separation pressure values variable in multiple steps, wherein the separation pressure adjuster includes a pivoting member to pivot controllably about a shaft part and thereby place the separation pressure adjuster in any of multiples positions to vary the separation pressure to the respective separation pressure values.

2. The sheet supplying device of claim 1, wherein the separation pressure adjuster includes a spring holder to hold the spring, wherein a mounting posture of the spring holder is switchable among multiple mounting postures to vary the separation pressure.

3. The sheet supplying device of claim 2, wherein the spring holder includes a posture regulator to regulate an initial mounting posture of the spring holder, wherein the posture regulator is removable to change the mounting posture of the spring holder.

4. The sheet supplying device of claim 1, wherein the separation pressure adjuster includes:

a spring holder to hold the spring; and a holder receiver having holding parts to hold the spring holder at positions different in height.

5. The sheet supplying device of claim 4, wherein the separation pressure adjuster further includes:

a fall preventer to prevent the spring holder from falling from the holder receiver.

6. A sheet storing device comprising:

a container to contain sheets; and a separator to separate the sheets contained in the container one by one, including:

a separation pad to contact each of the sheets;

a spring to apply a separation pressure to the separation pad; and a separation pressure adjuster to adjust the separation pressure to one of separation pressure values variable in multiple steps, wherein the separation pressure adjuster includes a pivoting member to pivot controllably about a shaft part and thereby place the separation pressure adjuster in any of multiples positions to vary the separation pressure to the respective separation pressure values.

7. The sheet storing device of claim 6, wherein the separation pressure adjuster includes a spring holder to hold the spring, wherein a mounting posture of the spring holder is switchable among multiple mounting postures to vary the separation pressure.

8. The sheet storing device of claim 6, wherein the separation pressure adjuster includes a releaser to release the separation pressure, wherein the container is detachable from the sheet storing device, and the releaser releases the separation pressure when the container is detached from the sheet storing device.

9. The sheet storing device of claim 6, wherein the separation pressure adjuster includes:

a spring holder being rotatable in a storing direction of the sheets, to hold the spring, the spring holder having a lever part to be pressed by the container being detachable from the sheet storing device; and an adjuster being rotatable in a direction perpendicular to the storing direction, attached to the lever part, to vary a distance between the container and the lever part.

10. A sheet using apparatus comprising:

the sheet storing device of claim 6; and a liquid discharger to discharge a liquid on the sheet to form an image.

11. A liquid discharging apparatus comprising:

the sheet storing device of claim 6; and a liquid discharger to discharge a liquid on the sheet to form an image.

* * * * *